US007597802B2

(12) United States Patent
Ledsworth

(10) Patent No.: US 7,597,802 B2
(45) Date of Patent: Oct. 6, 2009

(54) DRAIN FILTRATION APPARATUS

(76) Inventor: C. Raymond Ledsworth, 18027 Topham St., Encino, CA (US) 91316

( * ) Notice: Subject to any disclaimer, the term of this patent is extended or adjusted under 35 U.S.C. 154(b) by 0 days.

(21) Appl. No.: 11/859,084

(22) Filed: Sep. 21, 2007

(65) Prior Publication Data

US 2008/0217224 A1 Sep. 11, 2008

Related U.S. Application Data

(60) Provisional application No. 60/826,727, filed on Sep. 22, 2006.

(51) Int. Cl.
*E03F 5/14* (2006.01)

(52) U.S. Cl. ..... 210/163; 210/170.03; 210/474; 404/4

(58) Field of Classification Search ..... 210/163, 210/164, 170.03, 306, 308, 460, 474, 532.1; 404/4, 5

See application file for complete search history.

(56) References Cited

U.S. PATENT DOCUMENTS

| | | | | | |
|---|---|---|---|---|---|
| 527,580 | A * | 10/1894 | Barrett | 210/164 |
| 646,876 | A * | 4/1900 | Schreck | 210/470 |
| 960,901 | A * | 6/1910 | Hall | 210/308 |
| 1,457,637 | A * | 6/1923 | Sievers | 210/163 |
| 1,507,531 | A * | 9/1924 | Vaudell | 210/164 |
| 1,739,559 | A * | 12/1929 | Owens | 210/306 |
| 1,862,134 | A * | 6/1932 | Boosey | 210/163 |
| 2,079,269 | A * | 5/1937 | Williams | 210/163 |
| 2,094,434 | A * | 9/1937 | Sherriff | 210/163 |
| 2,497,577 | A * | 2/1950 | Biggerstaff | 210/164 |
| 5,820,762 | A | 10/1998 | Bamer et al. | |
| 5,855,774 | A | 1/1999 | Boelter | |
| 6,083,402 | A | 7/2000 | Butler | |
| 6,093,314 | A | 7/2000 | Wilson et al. | |
| 6,200,484 | B1 | 3/2001 | McInnis | |
| 6,214,216 | B1 | 4/2001 | Isaacson | |
| 6,217,757 | B1 * | 4/2001 | Fleischmann | 210/163 |
| 6,241,882 | B1 * | 6/2001 | Allard | 210/164 |
| 6,270,663 | B1 | 8/2001 | Happel | |
| 6,328,882 | B1 | 12/2001 | Rosenblatt | |
| 6,406,620 | B1 * | 6/2002 | Rogers | 210/163 |
| 6,467,994 | B1 | 10/2002 | Ankeny et al. | |
| 6,533,941 | B2 | 3/2003 | Butler | |
| 6,743,354 | B1 * | 6/2004 | Evans et al. | 210/164 |
| D501,672 | S | 2/2005 | Ledsworth | |
| 6,869,525 | B1 | 3/2005 | Happel | |
| 7,052,207 | B1 | 5/2006 | Wimberger | |
| 7,288,188 | B2 * | 10/2007 | Al-Assfour | 210/164 |
| 2003/0034286 | A1 | 2/2003 | Butler | |
| 2005/0183997 | A1 | 8/2005 | Happel et al. | |
| 2005/0218049 | A1 | 10/2005 | Happel | |
| 2006/0124519 | A1 * | 6/2006 | Glazik | 210/163 |
| 2006/0163130 | A1 * | 7/2006 | Happel et al. | 210/163 |

* cited by examiner

*Primary Examiner*—Christopher Upton
(74) *Attorney, Agent, or Firm*—Sheldon Mak Rose & Anderson PC; Michael F. Fedrick

(57) ABSTRACT

A drain filtration apparatus including a catch basin and a filter housing. The catch basin includes a conduit extending upward from a drain opening in the catch basin, the upper vertical edge of the conduit being lower than the opening of the catch basin. The filter housing is removably securable to the upper portion of the conduit and includes a cover having an upper surface sufficient to cover the upper opening of the conduit as well as an elongated circumferential portion having openings which extend downwardly from the cover.

14 Claims, 5 Drawing Sheets

DRAIN FILTRATION APPARATUS

CROSS-REFERENCE TO RELATED APPLICATIONS

This application claims the benefit of priority from U.S. Provisional Patent Application No. 60/826,727, filed Sep. 22, 2006 and titled "Drain Filtration Apparatus," the disclosure of which is incorporated herein by reference in its entirety.

BACKGROUND

Storm drains are typically covered by a grate, both for safety reasons and to prevent the entry of solid materials into sewers. Such a grating, however, allows the passage of smaller particulates into sewers. Standard storm drains therefore do not prevent the entry of environmentally hazardous materials, such as chemical liquids and plastic particulates, into sewer systems. In some cases, sewer lines carry such materials directly into the ocean or other natural bodies of water.

In order to better control the flow of materials into a sewer system, catch basins for use in sewer drains have been designed. For example, U.S. Pat. No. 7,052,207 to Wimberger discloses a catch basin having a drain tube covered with a filtration sock. U.S. Pat. No. 6,200,484 to McInnis discloses an alternative catch basin which makes use of a filter basket having openings sized to filter out solid debris from run-off water. Other catch basin designs are disclosed in U.S. Pat. Nos. 6,869,525; 6,093,314; and D501,672, and in U.S. Patent Publication No. 2005/0183997. There remains a need, however, for improved systems for filtering materials that pass through a sewer drain.

SUMMARY

The present drain filtration apparatus comprises an improved design for a catch basin for removing unwanted solid and liquid materials that may flow through a drain, such as a sewer drain. In the present apparatus, a conduit leading out to a drain extends upwardly from the base of the catch basin to a point below the opening of the catch basin. The upper portion of the conduit includes a filter housing, which is preferably removably secured to the conduit and which includes openings through which liquids can pass into the interior of the conduit and then out of the catch basin through the lower portion of the conduit. Heavier particulates which fall into the catch basin will settle at the bottom of the catch basin outside the conduit, while the openings of the filter housing can be sized to exclude other solid particulates. The filter housing can be further provided with a filter material for removing or detoxifying unwanted materials which pass through the openings of the filter housing. Supports can also be provided in the lower portion of the catch basin in order to elevate the catch basin to a height which does not interfere with the flow of liquids through a sewer or other conduit, such as in a refinery, conducting liquids away from the catch basin.

In one embodiment, the present drain filtration apparatus includes a catch basin and a filter housing in the catch basin. The catch basin comprises an opening at the top of the catch basin, one or more vertical walls extending downwardly from the opening, a base joined in a sealing manner to a lower portion of the one or more vertical walls, and a conduit extending upwardly from a drain opening in the base to an upper vertical edge which is lower than the opening. The lower portion of the conduit is joined to the drain opening in a sealing manner so that the inner surfaces of the one or more vertical walls, the upper surface of the base, and the outer surface of the conduit together form a receptacle. The catch basin can comprise one or more supports, preferably at least three supports, connected to and extending downwardly from a lower portion of the catch basin.

The filter housing of the present apparatus in this embodiment comprises a cover and an elongated circumferential portion extending downwardly from the cover, the elongated circumferential portion comprising openings leading from an exterior of the elongated circumferential portion to an interior of the elongated circumferential portion. The openings are preferably sized to exclude solid particulates, and the elongated circumferential portion also preferably contains a filter material to absorb, bind or purify materials which pass through the filter, particularly liquid materials.

The filter housing is preferably configured to be removably secured to the upper portion of the conduit. In this way, filter material in the filter housing can be replaced when necessary by removing the filter housing from the catch basin, replacing the filter material, and then placing the filter housing back in the catch basin. The filter housing can be removably secured to the catch basin, for example, by providing the elongated circumferential portion with an exterior surface configured to engage the inner surface of the upper portion of the conduit, so that liquid is substantially prevented from passing directly into the conduit from the catch basin. The cover of the filter housing has an upper surface with an area sufficient to cover the upper opening of the conduit when the filter housing is secured to the catch basin, so that liquid entering the catch basin does not fall directly into the conduit.

DRAWINGS

These and other features, aspects and advantages of the present invention will become better understood with regard to the following description, appended claims, and accompanying figures where:

All dimensions specified in this disclosure are by way of example only and are not intended to be limiting. Further, the proportions shown in these Figures are not necessarily to scale. As will be understood by those with skill in the art with reference to this disclosure, the actual dimensions of any device or part of a device disclosed in this disclosure will be determined by their intended use.

Definitions

As used herein, the following terms and variations thereof have the meanings given below, unless a different meaning is clearly intended by the context in which such term is used.

"Downward" and "downwardly" mean in the direction of or toward a support surface on which the present apparatus is or can be positioned. "Upward" and "upwardly" mean in the opposite direction, i.e. away from such a support surface.

"Elongated" refers to a configuration or shape having a length which is longer than its width.

"Horizontal" refers to an orientation approximately parallel to (i.e., not substantially extending toward or away from) a support surface on which the present apparatus is supported when in use.

"Lower" refers to the relative position of a component in the present apparatus which is closer to or toward a support surface on which the present apparatus is positioned. "Upper" refers to the relative position of a component in the present apparatus which is further from or away from such a support surface.

"Outward" and "outwardly" mean in a direction away from the horizontal or vertical center of the apparatus or of a component part of the apparatus.

"Vertical" refers to an orientation extending toward or away from a support surface on which the present apparatus is supported when in use, preferably at an angle of about 90° with respect to the support surface.

As used herein, the term "comprise" and variations of the term, such as "comprising" and "comprises," are not intended to exclude other additives, components, integers or steps. The terms "a," "an," and "the" and similar referents used herein are to be construed to cover both the singular and the plural unless their usage in context indicates otherwise.

Catch Basin

Figure 1:
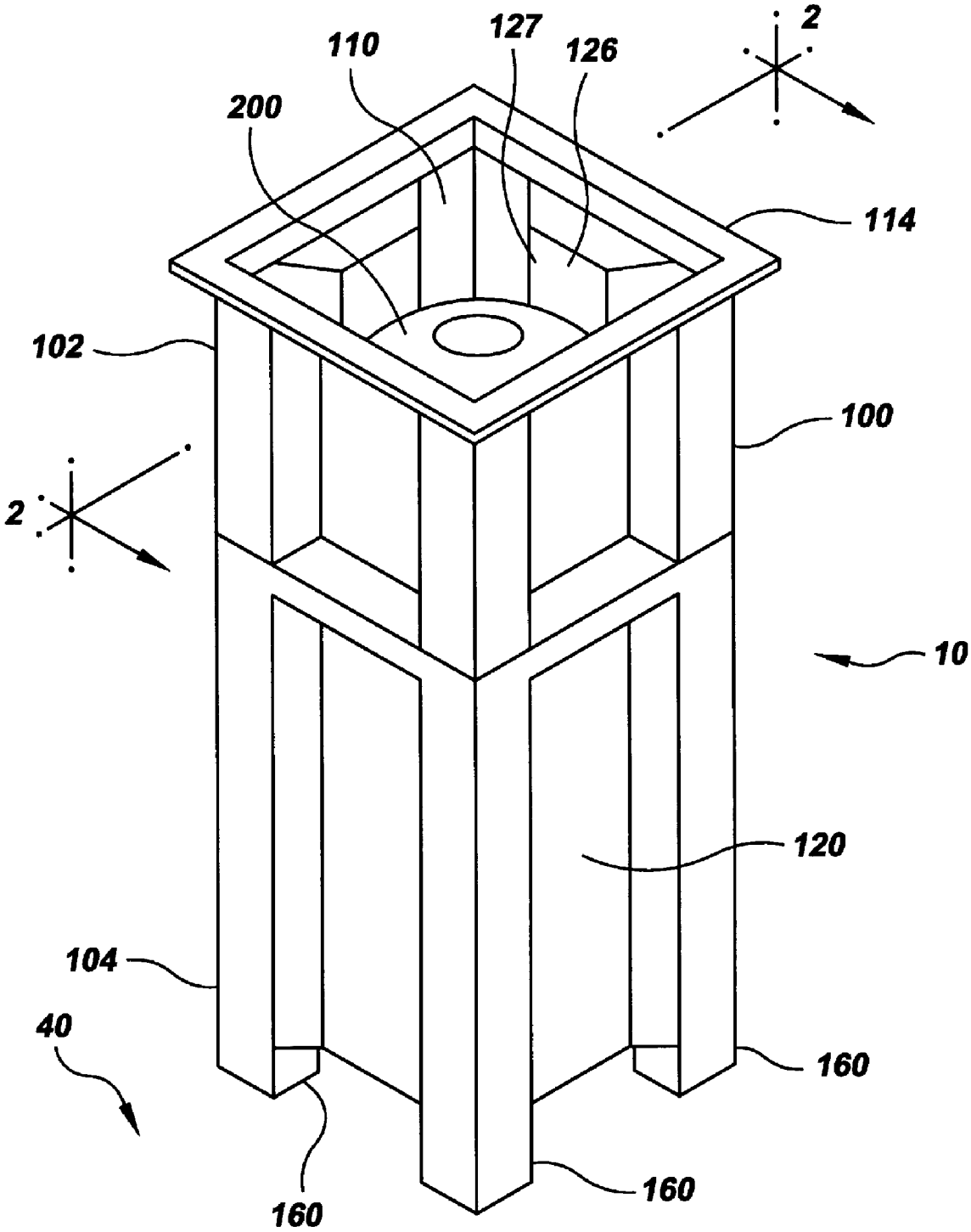
FIG. 1 is a perspective view of one embodiment of the present apparatus.
Figure 2:
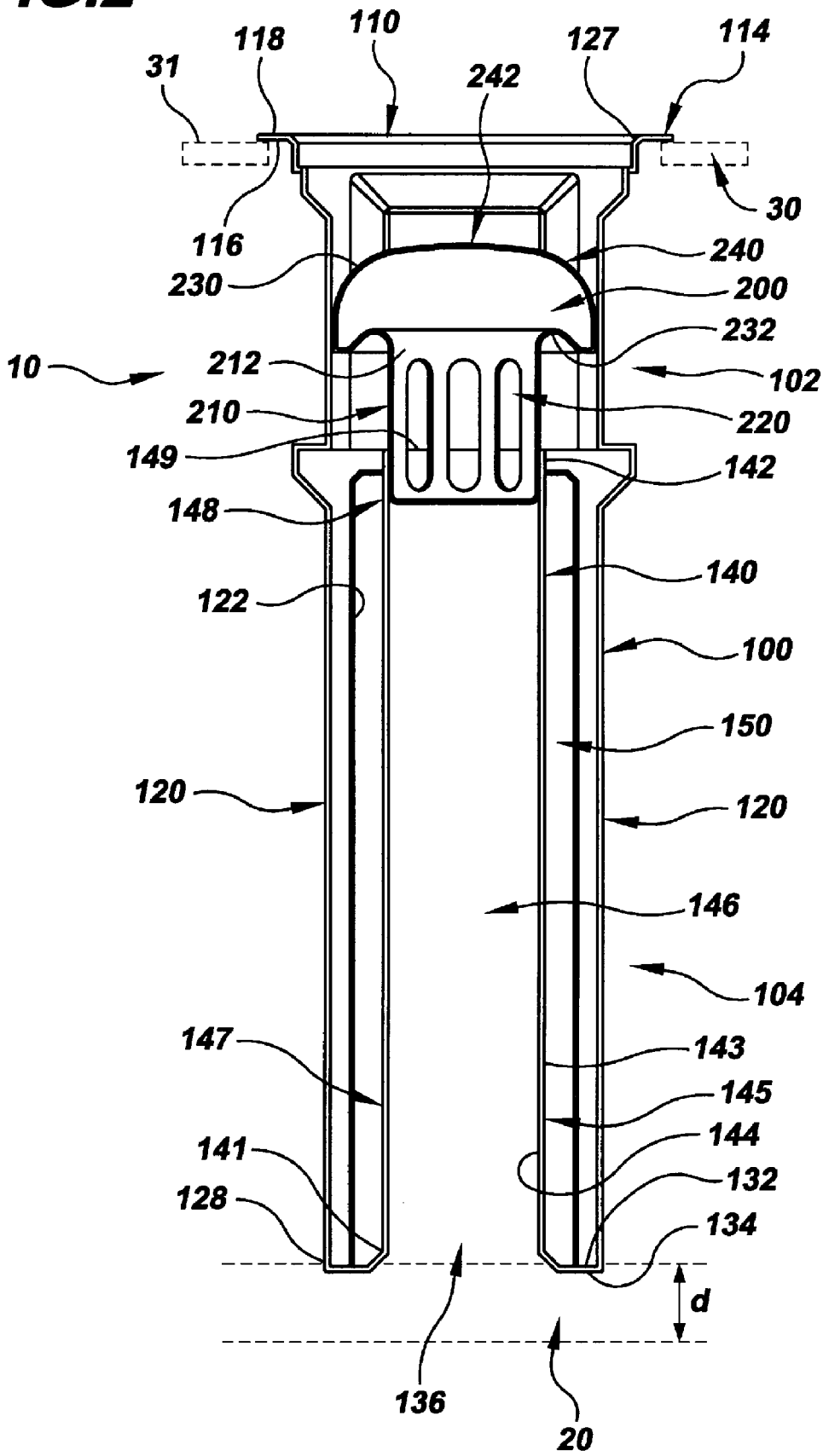
FIG. 2 is a cross-sectional view of the embodiment shown in FIG. 1 taken along line 2-2.

As best seen in FIGS. 1 and 2, the present drain filtration apparatus 10 generally comprises a catch basin 100 and a filter housing 200 for placement within the catch basin 100. The catch basin 100 comprises an opening 110 formed at or adjacent to the upper vertical edges 127 of one or more vertically extending walls 120 which extend downward from the opening 110. The walls 120 are integrally molded with or joined at a lower end, and preferably at their lower vertical edge 128, with a base 130. In the embodiment shown in FIGS. 1-4, the present apparatus 10 comprises four walls 120 which are joined in a sealing manner to the base 130, so that the inner surfaces 122 of the walls 120 cooperate with the upper surface 132 of the base 130 to form (together with the conduit 140, as described below) a receptacle 150 in the interior of the catch basin 100. The receptacle 150 collects both solid objects and liquids which fall through the opening 110 in the upper portion 102 of the catch basin 100.

The base 130 of the catch basin 100 further includes a drain opening 136 for conducting fluids out of the catch basin, such as into a sewer drain 20. The drain opening 136, however, is formed integrally with or joined in sealing engagement with a lower portion 147, and preferably with a lower vertical edge 141, of a conduit 140. The conduit 140 extends upwardly from the base 130 of the catch basin 100 to an upper opening 149 in the upper portion 148 of the conduit 140 which is below the opening 110 of the catch basin 100. In this way, when a liquid enters the receptacle 150 formed in the catch basin 100 by the inner surface or surfaces 122 of the walls 120, the upper surface 132 of the base 130, and the exterior surface 145 of the conduit 140, such liquid will fill the receptacle 150 up to the level of the upper opening 149 of the conduit 140, at which point (in the absence of the filter housing 200) it can flow over the upper vertical edge 142 (in the embodiment of FIGS. 1-4) and then downward through the interior 146 of the conduit 140 until it exits the catch basin 100 through the drain opening 136 and into a further liquid conduit, such as a sewer drain 20.

In the embodiment of the present apparatus 10 shown in FIGS. 1-4, the opening 110 is illustrated as having a generally rectangular shape, and the walls 120 are generally rectangular in horizontal cross-section, while the conduit 140 (as well as the filter housing 200) are shown as having a generally circular horizontal cross-section. It is to be understood, however, that the opening 110, the walls 120, and the conduit 140 can be formed in any convenient shape or configuration so as to perform the function of collecting and draining liquids as described herein. The generally rectangular shape of the opening 110 of the catch basin 100 is preferred in embodiments of the present apparatus 10 which are to be placed in drains having a generally rectangular opening, such as some sewer drains.

The present apparatus 10 can be supported and/or secured in a drain in a number of ways. In a preferred embodiment, shown in FIGS. 2-4, the upper portion 102 of the catch basin 100 includes a rim 114 at its upper end. The rim 114 projects outwardly from one or more of the walls 120 of the catch basin 100 in a generally horizontal direction. The rim 114 comprises a lower surface 116 which is designed to overlap with and preferably contact the upper surface 31 of a drain opening 30. In one embodiment, the rim 114 can act to support the catch basin 100 if it is formed from a sufficiently rigid and strong material. In the embodiment shown in FIGS. 1-4, the rim 114 is configured to contact the upper surface 31 of the drain opening 30 so as to stabilize the catch basin 100 with regard to movement in a lateral or horizontal direction.

Figure 3:
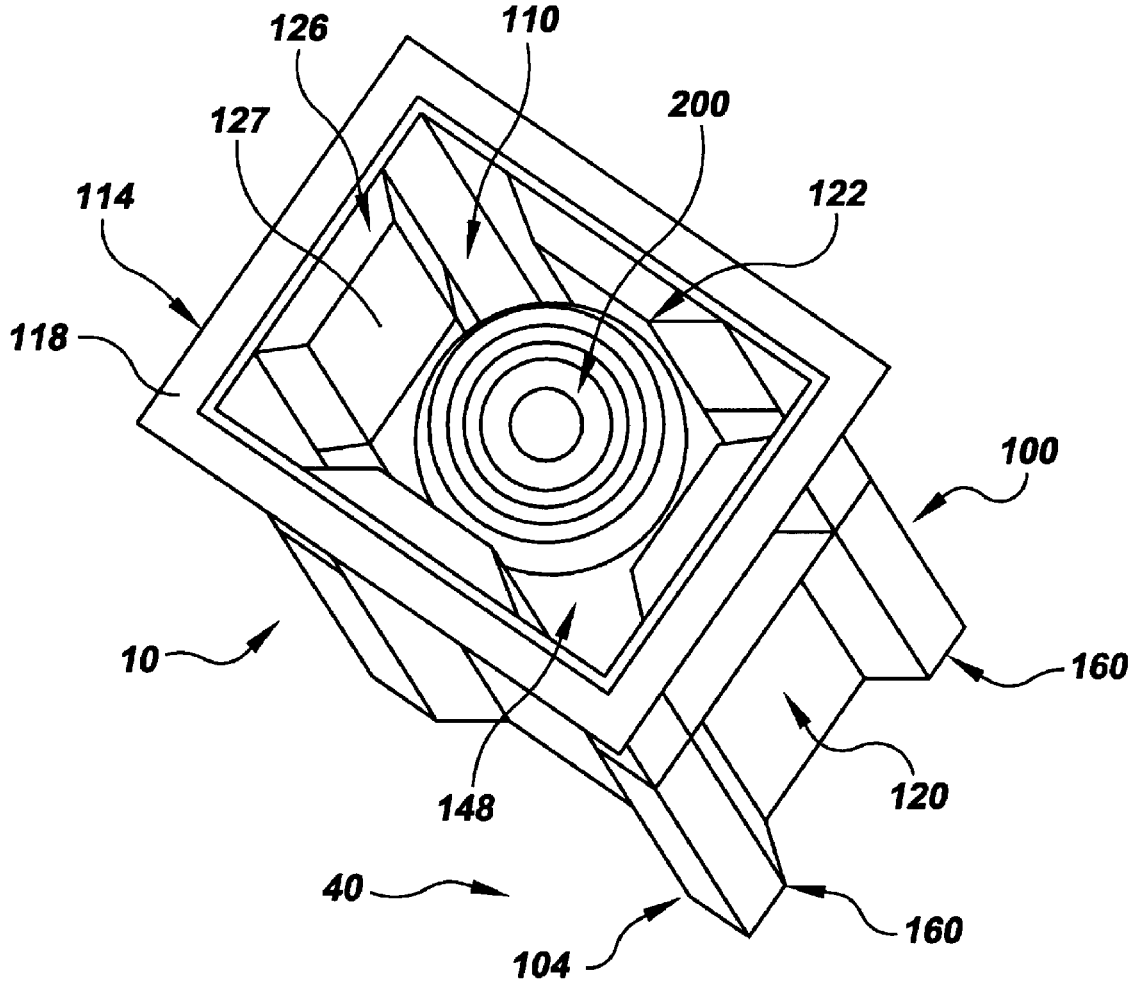
FIG. 3 is a top perspective view of the embodiment of the present apparatus shown in FIG. 1.

As shown in FIGS. 1 and 3, the rim 114 can form a circumferential projection around the opening 110 of the catch basin 100. However, in alternative embodiments, the rim 114 can comprise one or more flanges projecting outward from the upper portion 102 of the catch basin 100. Preferably, the rim 114 is sufficiently thin or is otherwise configured to allow a screen or grate to be placed on top of the rim 114, i.e., proximate to or in contact with the upper surface 118 of the rim 114, while allowing such screen or grate to be secured to an adjacent road or other structure.

Figure 4:
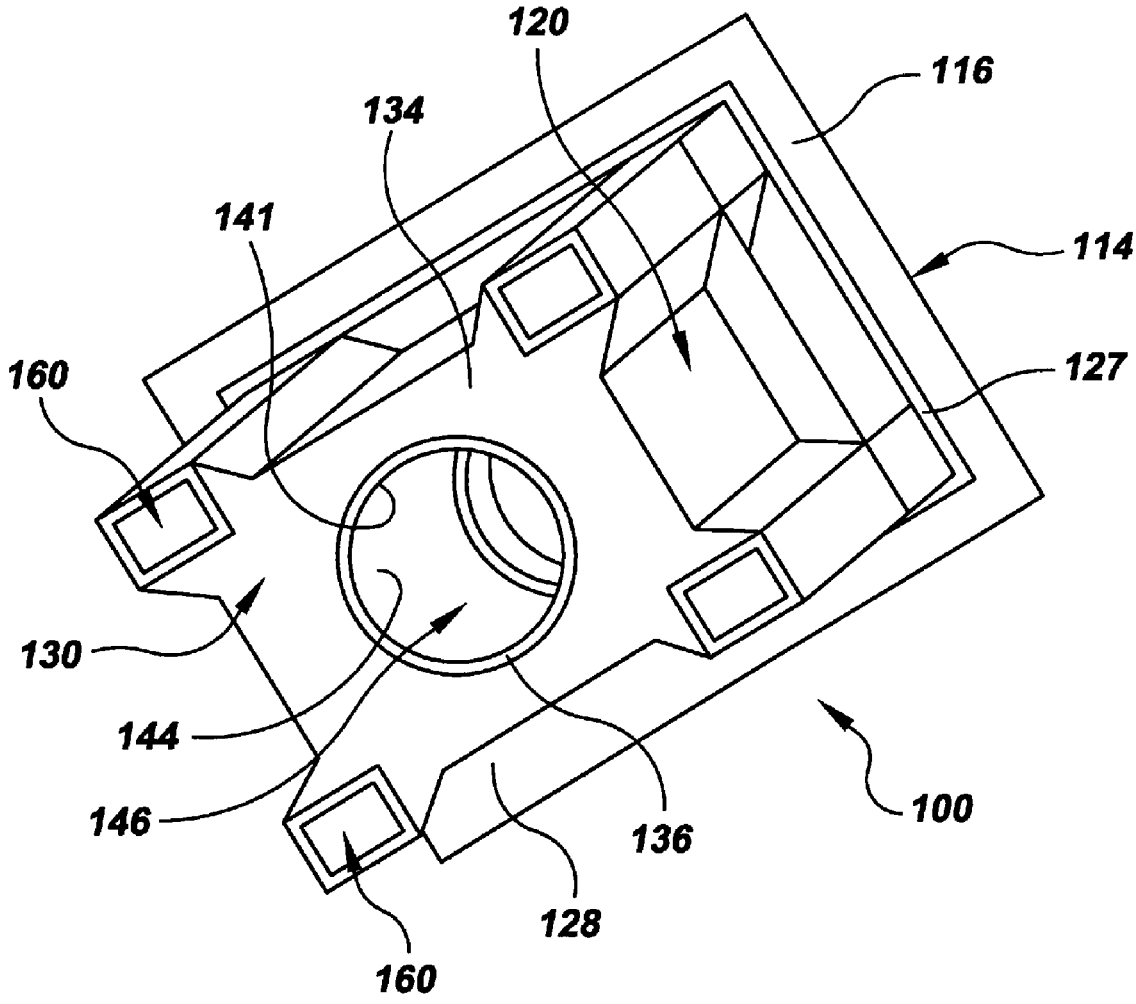
FIG. 4 is a bottom perspective view of the embodiment of the present apparatus shown in FIG. 1.

As best seen in FIGS. 1 and 4, the catch basin 100 preferably comprises supports 160 projecting downward from the lower portion 104 of the catch basin 100, and preferably from the lower surface 134 of the base 130. Such supports 160 support the present apparatus 10 on a support surface 40, such as the bottom of a sewer drain 20. In a preferred embodiment, the supports 160 bear the majority of the weight of the present apparatus 10 (including any materials located in the apparatus), and more preferably, bear most or all of the weight the present apparatus 10. The supports can be square in cross-section, as in the illustrated embodiment, circular (i.e., cylindrical), or of other appropriate shape.

As shown in FIGS. 1, 3 and 4, the catch basin 100 can be provided with four supports 160, one projecting downwardly from each corner of the generally rectangular catch basin 100. However, a larger or smaller number of supports 160 can be used to support the present apparatus 10. One or more supports can be used, preferably at least two, and more preferably at least three supports 160 are included in the present apparatus 10, so that it can rest stably on a surface of a sewer drain or other structure in communication with a conduit for liquids. The supports 160 need to be strong enough to support the weight of the apparatus 10 but are preferably of a minimal width and/or cross-sectional area, so as not to block the flow of liquids through a conduit on which the apparatus 10 rests. In a preferred embodiment, the supports 160 project downwardly from the lower surface 134 of the base 130 for a distance which is approximately the same as the diameter (shown as "d" in FIG. 2) of a conduit which conducts liquids away from the apparatus 10. This also serves to minimize any obstruction of liquid flow through the conduit.

The catch basin can be made of any advantageous material, but is preferably made from a polymer material in order to minimize the weight of the apparatus 10. The material used to form the catch basin 100 should be selected so as to be able to withstand contact with any liquids which are anticipated to flow through the catch basin 100. Thus, for use in drains, water resistance is an important criterion in material selection. In one embodiment, the material used is polyethylene, which can be rotomolded or injection molded. Particular polyethylene materials which can be used include linear low density polyethylene (LLDPE), high density polyethylene (HDPE), and cross linked polyethylene (XLPE).

Filter Housing

Figure 5:
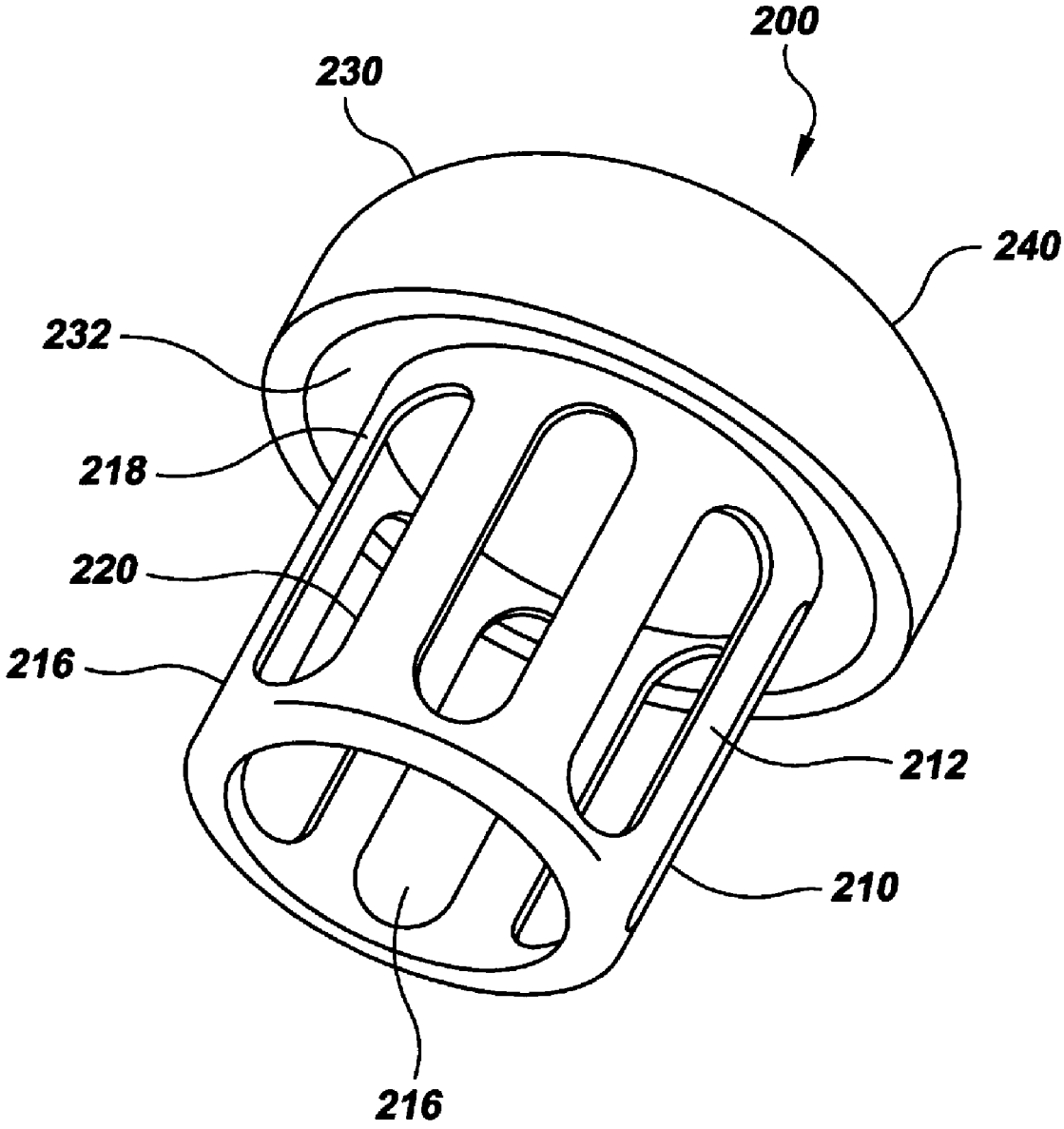
FIG. 5 is a perspective view of one embodiment of a filter housing of the present apparatus.

The present apparatus 10 includes a filter housing 200, best seen in FIG. 5. The filter housing 200, in a preferred embodiment, comprises an elongated circumferential portion 210 which extends downwardly from a cover 230 when the filter housing 200 is positioned in the catch basin 100. The elongated circumferential portion 210 further includes openings 220 in order to allow liquid to pass from the receptacle 150 of the catch basin 100 through the openings 220 and into the interior 216 of the elongated circumferential portion 210 of the filter housing 200. The openings 220 are sized to exclude larger solids and particulates from passing through the openings 220, thereby maintaining them in the receptacle 150 of the catch basin 100 and allowing their removal for subsequent disposal. In preferred embodiments, the openings 220 are elongated in configuration, but can have any convenient shape or dimension for accomplishing their intended purpose.

As shown in FIG. 2, in the illustrated embodiment the exterior surface 212 of the lower portion 216 of the elongated circumferential portion 210 is configured to engage the inner surface 144 of the conduit 140 in a close-fitting manner, and more preferably in sealing engagement with the inner surface 144 of the conduit 140. In this way, liquid contained in the receptacle 150 will flow through the openings 220 of the filter housing 200 when the level of such liquid reaches the upper vertical edge 142 of the conduit 140, and the liquid does not substantially flow between the inner surface 144 of the conduit 140 and the exterior surface 212 of the elongated circumferential portion. In an alternative embodiment, openings can be provided in the upper portion 148 of the conduit 140, and liquid can flow through such openings and into the openings 220 of the filter housing 200. In this case a close fit between the conduit 140 and the elongated circumferential portion 210 should be provided below such openings in the conduit 140, to allow the filter housing 200 to be placed in the conduit 140 so as to allow liquid to flow through the filter housing 200 prior to flowing downward through the conduit 140.

The cover 230 of the filter housing 200 is attached to or integrally molded with an upper portion 218 of the elongated circumferential portion 210. In the embodiment shown in FIGS. 2 and 5, the cover 230 is further provided with an upper surface 240 having a diameter larger than that of the elongated circumferential portion 210 so as to cover and extend outwardly beyond the upper portion 218 of the elongated circumferential portion 210. The upper surface 240 preferably has a vertical height (when positioned in the catch basin 100) which is highest at a center portion 242 and which extends downward as it extends horizontally outward, e.g. such as the spherical configuration shown in this embodiment. In this way, liquid entering the opening 110 of the catch basin 100 which contacts the upper surface 240 of the filter housing 200 will flow over the upper surface 240 and then downward into the receptacle 150 of the catch basin 100.

The cover also 230 preferably includes one or more projections extending outward from the elongated circumferential portion 210. Such projections are configured to stop the filter housing 200 from being placed into the conduit 140 further than the projection 232. In the embodiment shown in FIGS. 2 and 5, the projection comprises an annular rim 232 which is integrally molded with or otherwise joined to the elongated circumferential portion 210.

As can be seen in FIGS. 1 and 3, the interior portions of the walls 120 of the catch basin 100 can be provided with projections 126 in order to provide lateral stability to the filter housing 200 when it is secured to the conduit 140 of the catch basin 100. In the embodiment shown in FIGS. 1 and 3, the projections 126 include a surface 127 which abuts the cover 230 of the filter housing 200, such that the extent of lateral (horizontal) movement by the cover 230 of the filter housing 200 is limited to the distance between the projections 126 and the cover 230 of the filter housing 200.

In a preferred embodiment, the filter housing 200 contains a filter material, such as in a cartridge, in the interior 216 of the elongated circumferential portion 210. The filter material is positioned such that liquids flowing through the openings 220 and into the interior 216 will flow through the filter material prior to flowing into the conduit 140 of the catch basin 100. Such a filter cartridge advantageously comprises materials which absorb or deactivate unwanted chemical components of liquids which flow through the filter housing 200, such as carbon or coconut. Although a filter material can be associated with the filter housing 200 outside of the elongated circumferential portion 210, interior placement is preferred. In this case the filter housing advantageously includes a means for accessing the interior of the filter housing 200 in order to allow the filter material to be changed out. Alternatively, the filter housing 200, including any filter material, can simply be disposable.

The filter housing 200 can be removably secured to the catch basin 100 in any of a number of ways known to the art. In the embodiment shown in FIGS. 1-5, the exterior surface of the elongated circumferential portion 210 of the filter housing 200 engages the inner surface 144 of the conduit 140. The elongated circumferential portion 210 preferably provides a friction fit with the conduit, and also preferably forms a seal so that liquids pass into the interior 146 of the conduit 140 exclusively or substantially through the openings 220 of the filter housing 200. In alternative embodiments, the filter housing 200 can engage the outer surface 143 of the conduit 140 in order to provide such a friction fit, or the filter housing 200 can be sealed along the upper vertical edge 142 of the conduit 140. In yet a further alternative embodiment, the filter housing 200 can be integrally molded with or otherwise joined to the conduit 140 such that removal of a filter cartridge and/or any filter material is accomplished by opening and then replacing the cover 230.

Method of Use

In use, the present apparatus 10 can be installed by placing it in a drain 30 such that the rim 114 covers the opening of the drain. In order to further secure the apparatus 10, a grate or other securing means can be attached to or through the upper surface 118 of the rim 114, for example. The catch basin 100 is sized so that when the apparatus 10 is placed in a drain 30 in this fashion, the supports 160 rest on a support surface 40 below the drain 30 so as to support the catch basin 100. The support surface 40 is in liquid communication with a further drain or liquid conduit for conducting liquid which passes through the apparatus 10 away from the drain 30 and from the apparatus 10. As stated above, the supports 160 are preferably sized so that they support the catch basin 100 at a height which is approximately the same as or greater than the diameter ("d" in FIG. 2) of the conduit or conduits 20 which conduct fluid away from the apparatus 10.

When liquid flows through the opening 110 of the catch basin 100, it flows either directly into the receptacle 150 of the catch basin 100 or otherwise first contacts the upper surface 240 of the filter housing 200, after which it flows downward and into the receptacle 150. Any solid materials carried with such liquid will tend to settle in the lower portion 104 of the catch basin 100. Such materials can be removed through the use of a vacuum or by simply removing the apparatus 10 and dumping such materials out.

When the level of liquid contained in the receptacle 150 reaches the upper vertical edge 142 of the conduit 140 of the catch basin 100, it will flow through the openings 220 in the filter housing 200 into the interior 216 of the elongated circumferential portion 210 of the filter housing 200. If a filter material is contained in the interior 216 of the elongated circumferential portion 210, then such liquid will flow through the filter material before leaving the filter housing 200. When such liquid leaves the filter housing 200, it flows downward through the action of gravity through the interior 146 of the conduit 140 and from there flows through the drain opening 136 in the catch basin 100.

Although the present invention has been discussed in considerable detail with reference to certain preferred embodiments, other embodiments are possible. The steps disclosed for the present methods are not intended to be limiting nor are they intended to indicate that each step depicted is essential to the method, but instead are exemplary steps only. Therefore, the scope of the appended claims should not be limited to the description of preferred embodiments contained in this disclosure. All references cited herein are incorporated by reference in their entirety.

What is claimed is:

1. A drain filtration apparatus, comprising:

(a) a catch basin comprising:

(i) a rim at an upper end of the catch basin extending around an upper opening of the catch basin;

(ii) one or more vertical walls extending downwardly from the rim, the rim projecting outwardly from the one or more vertical walls, wherein each of the vertical walls comprises an inner surface;

(iii) a base joined in a sealing manner to a lower portion of the one or more vertical walls, the base comprising a catch basin drain opening and an upper surface;

(iv) a conduit comprising an inner surface, an outer surface, an upper portion, a lower portion, an upper opening, and an upper vertical edge, the lower portion of the conduit being joined to the catch basin drain opening in a sealing manner, wherein the conduit extends upwardly from the catch basin drain opening in the base to the upper vertical edge, the upper vertical edge being lower than the upper opening of the catch basin, wherein the inner surfaces of the one or more vertical walls, the upper surface of the base, and the outer surface of the conduit together form a receptacle; and (v) one or more supports connected to and extending downwardly from the base of the catch basin for supporting the catch basin on a support surface; and (b) a filter housing comprising openings leading from an exterior of the filter housing to an interior of the filter housing, the filter housing further comprising a cover, wherein the cover comprises an upper surface having an area sufficient to cover the upper opening of the conduit.

2. The apparatus of claim 1, wherein the catch basin comprises at least three supports.

3. The apparatus of claim 1, wherein the rim is circumferential.

4. The apparatus of claim 1, wherein the lower portion of the conduit has a lower vertical edge, and wherein the lower vertical edge is joined to the drain opening in a sealing manner.

5. The apparatus of claim 1, wherein the filter housing comprises an elongated circumferential portion extending downwardly from the cover.

6. The apparatus of claim 5, wherein the elongated circumferential portion further comprises an exterior surface configured to engage the inner surface of the upper portion of the conduit.

7. The apparatus of claim 5, wherein the openings in the filter housing are present in the elongated circumferential portion.

8. The apparatus of claim 7, wherein the filter housing openings have an elongated configuration.

9. The apparatus of claim 1, wherein the filter housing is configured to be removably secured to the upper portion of the conduit.

10. The apparatus of claim 1, further comprising a filter material in the interior of the filter housing.

11. The apparatus of claim 1, further comprising one or more projections extending from an interior portion of the one or more vertical walls of the catch basin to provide lateral stability to the filter housing.

12. A drain and catch basin, comprising:

(a) a drain comprising:

(i) a drain opening at an upper end for receiving a flow of liquid;

(ii) a drain conduit at a lower end for conducting a flow of liquid away from the drain; and (iii) a bottom;

(b) a catch basin comprising:

(i) a rim around a catch basin opening and in contact with the drain opening;

(ii) one or more vertical walls extending downwardly from the rim, wherein each of the walls comprises an inner surface;

(iii) a base joined in a sealing manner to a lower portion of the one or more vertical walls, the base comprising a drain opening and an upper surface;

(iv) a catch basin conduit comprising an inner surface, an outer surface, an upper portion, a lower portion, an upper opening, and an upper vertical edge, the lower portion of the catch basin conduit being joined to the drain opening in a sealing manner, wherein the catch basin conduit extends upwardly from the drain opening in the base to the upper vertical edge, the upper vertical edge being lower than the opening, wherein the inner surfaces of the one or more vertical walls, the upper surface of the base, and the outer surface of the catch basin conduit together form a receptacle; and (v) one or more supports connected to and extending downwardly from the base of the catch basin to the bottom of the drain for supporting the catch basin on the bottom of the drain, wherein the supports extend downwardly for a distance which is approximately the same as the diameter of the drain conduit; and (c) a filter housing comprising openings leading from an exterior of the filter housing to an interior of the filter housing, the filter housing further comprising a cover, wherein the cover comprises an upper surface having an area sufficient to cover the upper opening of the catch basin conduit.

13. The drain and catch basin of claim 12, wherein the rim comprises a lower surface which contacts an upper surface of the drain opening.

14. The drain and catch basin of claim 12, wherein the rim comprises a circumferential projection.

* * * * *